US008907220B2

(12) United States Patent
Fuse

(10) Patent No.: US 8,907,220 B2
(45) Date of Patent: Dec. 9, 2014

(54) HIGH-SPEED CARD CABLE

(75) Inventor: Kenichi Fuse, Hadano (JP)

(73) Assignee: Empire Technology Development LLC, Wilmington, DE (US)

( * ) Notice: Subject to any disclaimer, the term of this patent is extended or adjusted under 35 U.S.C. 154(b) by 141 days.

(21) Appl. No.: 13/122,961

(22) PCT Filed: Nov. 2, 2010

(86) PCT No.: PCT/US2010/055063

§ 371 (c)(1),
(2), (4) Date: Apr. 6, 2011

(87) PCT Pub. No.: WO2012/060818

PCT Pub. Date: May 10, 2012

(65) Prior Publication Data

US 2012/0103657 A1 May 3, 2012

(51) Int. Cl.
*H01B 7/08* (2006.01)

(52) U.S. Cl.
CPC ..... *H01B 7/0838* (2013.01)
USPC ..... 174/117 F; 174/117 FF

(58) Field of Classification Search
CPC ..... H01B 7/083; H01B 7/0838; H01B 7/18; H01B 7/0823; D02G 3/441
USPC ..... 174/171, 117 F, 117 FF, 117 M
See application file for complete search history.

(56) References Cited

U.S. PATENT DOCUMENTS 3,576,723 A * 4/1971 Angele et al. ..... 205/187
3,700,825 A * 10/1972 Taplin et al. ..... 174/36
3,958,066 A * 5/1976 Imamura et al. ..... 428/372
4,292,725 A * 10/1981 Larsson et al. ..... 29/419.1
4,616,102 A * 10/1986 Noorily ..... 174/36
4,698,457 A * 10/1987 Bordbar ..... 174/36
5,112,419 A 5/1992 Nakagawa
5,399,382 A * 3/1995 Burch et al. ..... 427/306
6,111,203 A * 8/2000 Cheng et al. ..... 174/117 F
6,202,264 B1 * 3/2001 Ishihara ..... 24/445
6,635,827 B2 * 10/2003 Yosomiya ..... 174/117 F
6,916,994 B2 * 7/2005 Glovatsky ..... 174/254
6,924,244 B2 * 8/2005 Takagi et al. ..... 442/181
6,992,138 B2 * 1/2006 Tsuji et al. ..... 525/131
2007/0193770 A1 8/2007 Ueno et al.
2008/0084681 A1 4/2008 Naito et al.
2008/0176471 A1 7/2008 Ogihara et al.

OTHER PUBLICATIONS

International Search Report and Written Opinion for International Patent Application No. PCT/US2010/055063 mailed on Jan. 19, 2011.

http://www.shinko-nylon.co.jp/mizusyori/seihin_01.html, 2003.

(Continued)

*Primary Examiner* — Boris Chervinsky
*Assistant Examiner* — Pete Lee
(74) *Attorney, Agent, or Firm* — Maschoff Brennan

(57) ABSTRACT

Techniques described herein generally relate to ground planes. In some examples, an electrical cable is described that can include multiple signal lines. The multiple signal lines can be arranged to extend along a length of the electrical cable. A ground plane can be spaced apart from the multiple signal lines. The ground plane can include a mesh structure and an electrically conductive layer that is arranged to coat the mesh structure. The mesh structure can include multiple resin fibers.

11 Claims, 4 Drawing Sheets

(56) References Cited

OTHER PUBLICATIONS http://miyamariken.co.jp/technical/index.htm, 2007.

Watanabe et al., An Investigation of FPC's High Frequency Characteristics, as found at http://www.fujikura.co.jp/00/gihou/gihou110/110_05.html, 2006.

* cited by examiner

HIGH-SPEED CARD CABLE

CROSS-REFERENCE TO RELATED APPLICATIONS

This application is a National Stage Entry of PCT Application No. PCT/US2010/055063, filed Nov. 2, 2010.

BACKGROUND

Unless otherwise indicated herein, the materials described herein are not prior art to the claims in the present application and are not admitted to be prior art by inclusion in this section.

Many communication devices and home information appliances such as personal computers electrically communicate with each other and/or internally via electrical cables, such as high-speed card cables, flexible print circuits and flexible flat cables. Some electrical cables used for electrical communication often include multiple signal lines, insulating tape, and adhesive.

Until recently, electrical communication using electrical cables occurred at relatively low speeds of several megahertz ("MHz") or less. At relatively low speeds of several megahertz or less, characteristic impedance of the electrical cables has a relatively insignificant impact on signals transmitted by the electrical cable and can often be ignored when designing the electrical cables.

In recent years, communication devices supporting electrical communication at speeds of 100 MHz or more have become more prevalent. At speeds of 100 MHz or more, characteristic impedance has a more significant impact on signals transmitted by the electrical cable. For example, without careful design and control of the characteristic impedance of the electrical cable, the electrical cable may be unable to effectively transmit signals through the electrical cable.

In addition to including multiple signal lines, insulating tape and adhesive, electrical cables that support communication at speeds of 100 MHz or more can additionally include distributed constant circuits and a ground plane. The characteristic impedance of such electrical cables may be affected by the dimensions of the signal lines and ground plane, the thickness of the insulating tape and adhesive, a dielectric constant of the insulating tape, and/or other parameters.

Many electrical cables are flexible. The operating environment in which an electrical cable is implemented may dictate a desired amount flexibility for the electrical cable. Greater flexibility can often be achieved by making an electrical cable thinner. As an electrical cable is made thinner, the distance between the signal lines and the ground plane decreases, the capacitance between the signal lines and the ground plane increases and the characteristic impedance of the electrical cable is changed.

One way to make an electrical cable thinner while keeping the characteristic impedance of the electrical cable at a desired value is to decrease the distance between the signal lines and the ground plane and decrease the width of the signal lines. However, reducing the width of the signal lines in an electrical cable inevitably leads to power loss caused by electric resistance (attenuation) and an increase in DC resistance. Thus, increasing the flexibility of an electrical cable by decreasing the distance between the signal lines and ground plane and maintaining characteristic impedance of the electrical cable at a particular value by decreasing the width of the signal lines results in an electrical cable that may not be suitable for communication at speeds of 100 MHz or more.

SUMMARY

Techniques described herein generally relate to ground planes.

In some examples, an electrical cable is described that can include multiple signal lines. The multiple signal lines can be arranged to extend along a length of the electrical cable. A ground plane can be spaced apart from the multiple signal lines. The ground plane can include a mesh structure and an electrically conductive layer that is arranged to coat the mesh structure. The mesh structure can include multiple resin fibers.

In some examples, methods of forming a ground plane are described that can include arranging multiple resin fibers to form a mesh structure. The mesh structure can include contact areas where resin fibers are arranged in contact with each other. The resin fibers can be fused together at the contact areas to form a fused mesh structure. The fused mesh structure can be plated with a conductive coating to form a ground plane.

In some examples, an electrical cable is described that can include multiple signal lines. The multiple signal lines can be arranged to extend along a length of the electrical cable. A ground plane can be spaced apart from the multiple signal lines. The ground plane can be configured to reduce noise on the multiple signal lines. The ground plane can include a mesh structure and an electrically conductive layer that is arranged to coat the mesh structure. The mesh structure can include multiple resin fibers fused together at multiple contact areas. An insulation layer can be arranged to surround the multiple signal lines and the ground plane. Two adhesive layers can extend along the length of the electrical cable. The multiple signal lines can be positioned between the two adhesive layers. One of the two adhesive layers can be positioned between the multiple signal lines and the ground plane.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
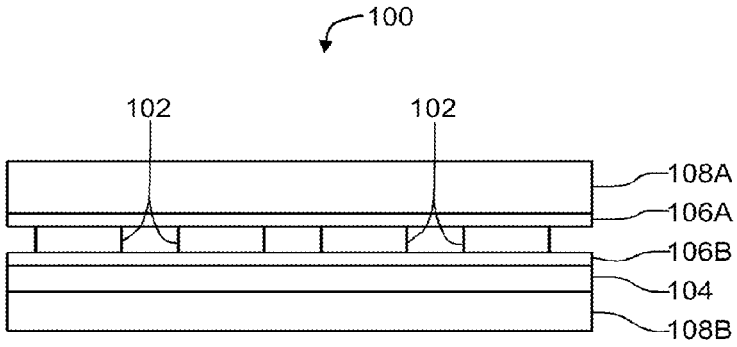
FIG. 1 is a block diagram of an illustrative embodiment of an electrical cable that can include a ground plane.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

Some embodiments disclosed herein relate generally to electrical cables such as high-speed card cables, flexible print circuits ("FPCs") and flexible flat cables ("FFCs"). Example embodiments may include electrical cables and ground planes that can be used in electrical cables. An example ground plane can include a mesh structure and an electrically conductive layer that is arranged to coat the mesh structure. The mesh structure can include multiple resin fibers that may be spun from a thermoplastic polymer.

The ground plane can be formed by arranging multiple resin fibers to form a mesh structure. For example, resin fibers can be woven together to form a mesh structure. The mesh structure can include contact areas where resin fibers are arranged in contact with each other. The resin fibers can be fused together at the contact areas to form a fused mesh structure. The fused mesh structure can be plated with a conductive coating to form the ground plane.

Some of the techniques described herein may be utilized to provide an inexpensive mesh-based ground plane. Such inexpensive mesh-based ground planes can be used in electrical cables. A mesh-based ground plane in accordance with at least some embodiments described herein can be used to form an electric cable that is more flexible than an electric cable with a solid ground plane and signal lines having the same width as signal lines in the electrical cable with the mesh-based ground plane. In particular, signal lines of a particular width in an electrical cable can be located closer to a mesh-based ground plane than a solid ground plane while resulting in electrical cables with the same characteristic impedance value. Because the signal lines can be located closer to the mesh-based ground plane, the electrical cable with the mesh-based ground plane may be more flexible than an electrical cable with a solid ground plane.

FIG. 1 shows a block diagram of an illustrative embodiment of an electrical cable 100 that is arranged in accordance with at least some embodiments described herein. The electrical cable 100 is representative of various electrical tape wires including, but not limited to, high-speed card cables, flexible print circuits ("FPCs"), flexible flat cables ("FFCs"), or other communication lines or communication cables, or the like or any combination thereof. Embodiments of the electrical cable 100 can be used, for instance, to electrically couple electronic devices, to electrically couple electronic circuits within an electronic device, and to electrically couple electronic components within an electronic circuit.

The electrical cable 100 may include multiple signal lines 102 and a ground plane 104. The electrical cable 100 may further include adhesive layers 106A, 106B (collectively "adhesive layers 106") and insulation layers 108A, 108B (collectively "insulation layers 108"). Each of the signal lines 102, ground plane 104, adhesive layers 106 and insulation layers 108 can extend a length of the electrical cable 100.

The signal lines 102 can be configured to carry electrical signals along the length of the electrical cable 100 and can be positioned between adhesive layers 106. Although four signal lines 102 are illustrated in FIG. 1, more generally the electrical cable 100 can have any number of signal lines 102.

The adhesive layers 106 can be configured to mechanically couple the signal lines 102 to the insulation layer 108 and ground plane 104.

The ground plane 104 can be spaced apart from the signal lines 102. For instance, the ground plane 104 can be spaced apart from the signal lines 102 by adhesive layer 106B which can be positioned between the signal lines 102 and ground plane 104. The ground plane can be configured to reduce electrical noise on the signal lines 102. Additional details regarding the ground plane 104 in accordance with at least some embodiments described herein are provided below.

The insulation layers 108 can be configured to insulate the signal lines 102 and ground plane 104. Although two insulation layers 108 are illustrated in FIG. 1, in other embodiments a single insulation layer 108 can be provided that surrounds the signal lines 102, ground plane 104 and adhesive layers 106, or three or more insulation layers can be provided.

Figure 2A:
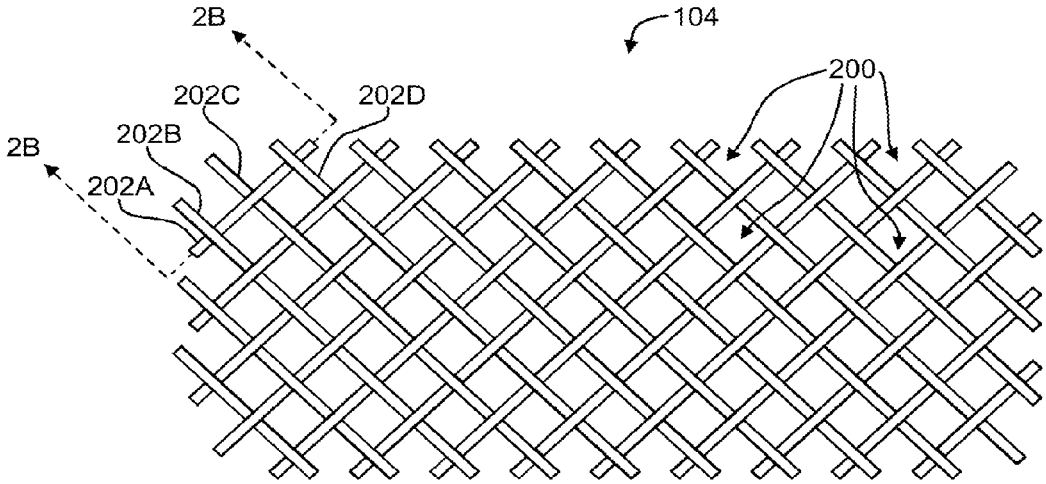
FIG. 2A is a top view of an illustrative embodiment of a portion of the ground plane of FIG. 1.
Figure 2B:
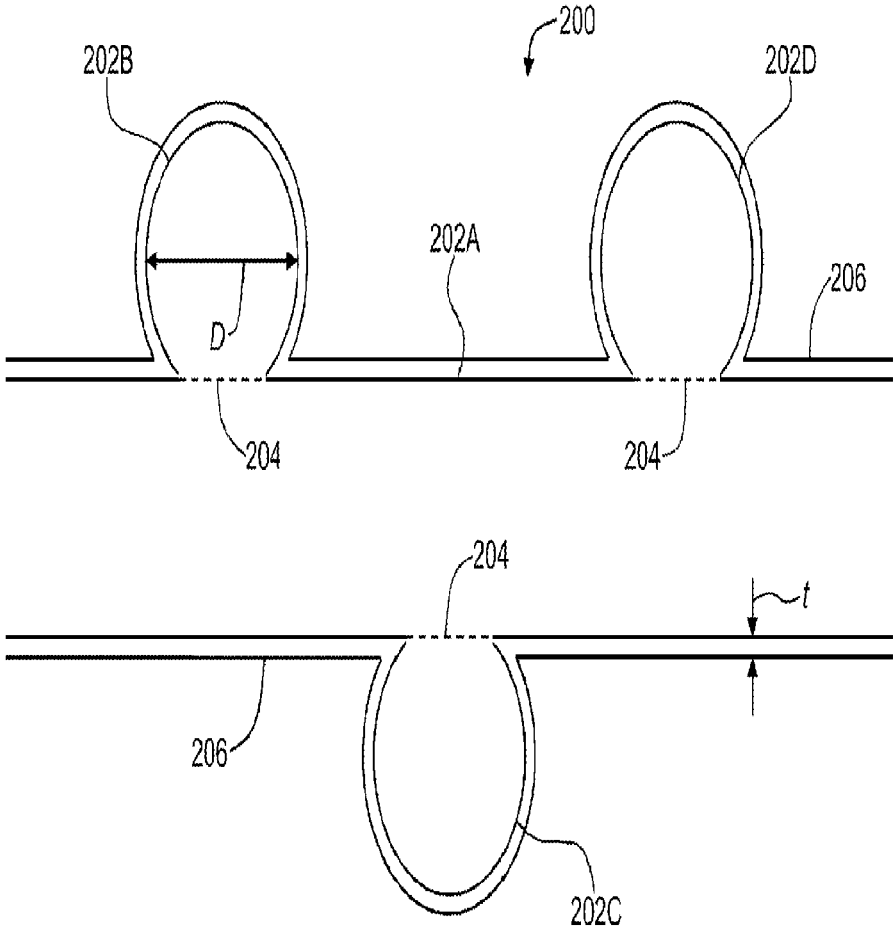
FIG. 2B is a cross-sectional view of an illustrative embodiment of a portion of the ground plane of FIG. 1.

FIG. 2A shows an illustrative example of a top view of a portion of the ground plane 104 arranged in accordance with at least some embodiments described herein. FIG. 2B shows an illustrative example of a cross-sectional view along cutting plane line 2B of FIG. 2A in accordance with at least some embodiments described herein.

With combined reference to FIGS. 2A and 2B, the ground plane 104 can include a mesh structure 200 formed from multiple elements 202, including elements 202A-202D. Note that not all of the elements 202 forming the mesh structure 200 are labeled in FIG. 2A.

The mesh structure 200 can be formed by weaving the elements 202 in a weave pattern and fusing the elements 202 together at contact areas 204 (FIG. 2B) where elements 202 are arranged in contact with each other. Contact areas 204 are generally denoted by dotted lines in FIG. 2B to represent that the elements 202 have already been fused together at the contact areas 204.

Examples of weave patterns contemplated by the present disclosure include, but are not limited to, plain weave, satin weave, twill weave, or the like or any combination thereof. In a plain weave, for example, warp and weft elements are aligned so they form a simple criss-cross pattern. Each weft element crosses the warp elements by going over one warp element, then under the next warp element, and so on. The next weft element goes under the warp elements that its neighbor went over and goes over the warp elements that its neighbor went under. In the illustrated embodiment, for instance, the elements 202 parallel to and including element 202A may represent weft elements while the elements 202 parallel to and including elements 202B-202D may represent warp elements (or vice versa) collectively arranged in a plain weave pattern.

In other embodiments, the mesh structure 200 can be formed without weaving the elements 202 in a weave pattern. For instance, the mesh structure 200 can be formed by aligning a first set of elements 202 in parallel with and spaced apart from each other. A second set of elements 202 arranged in parallel with and spaced apart from each other can then be laid across the first set of elements 202 at an angle such that each of the second set of elements 202 goes across the top of multiple ones of the first set of elements 202. The first set of elements 202 can then be fused with the second set of elements 202 at areas of contact with each other to form the mesh structure 200.

Each of elements 202 can include one or more resin fibers. The resin fibers can be spun into resin fibers from a suitable resin such as a thermoplastic polymer. Examples of thermoplastic polymers contemplated by the present disclosure include, but are not limited to, polyethylene, polypropylene, polycarbonate, polyethylene terephthalate ("PET"), polyethersulfone ("PES"), polyphenylene sulfide ("PPS"), and nylon. The particular thermoplastic polymer used to form the resin fibers that form a ground plane 104 in an electrical cable 100 may depend on characteristics of the thermoplastic polymer, such as stiffness, fatigue resistance, manufacturing cost, and the like, and corresponding desired characteristics of the electrical cable 100.

In the example of FIG. 2B, each of elements 202 may include a single resin fiber. In other embodiments, each of elements 202 may include a twine of two or more resin fibers. In still other embodiments, some elements 202 may include a single fiber while other elements 202 in the same mesh structure 200 may include two or more resin fibers.

Each of elements 202 may have a diameter D. The elements 202 may have the same diameter D or different respective diameters. In some embodiments, the diameter D of each element 202 may be less than about 1 mm. In other embodiments, the diameter D of each element 202 may range from about 0.1 mm to about 1 mm, or from about 0.3 mm to about 0.8 mm. In other embodiments, the diameter D of each element 202 may be about 0.3 mm.

The mesh structure 200 formed from elements 202 can be coated by an electrically conductive layer 206 (FIG. 2B). The electrically conductive layer 206 may be formed from one or more of copper, nickel, tin, silver, zinc, iron, gold, platinum, or other suitable conductive material(s).

Electrically conductive layer 206 may have a thickness t (FIG. 2B) of several micrometers ("μm"). In some embodiments, the thickness t of electrically conductive layer 206 may be less than about 3 μm. In other embodiments, the thickness t of electrically conductive layer 206 may range from about 0.5 μm to about 3 μm, or from about 1 μm to about 2.5 μm.

Figure 3:
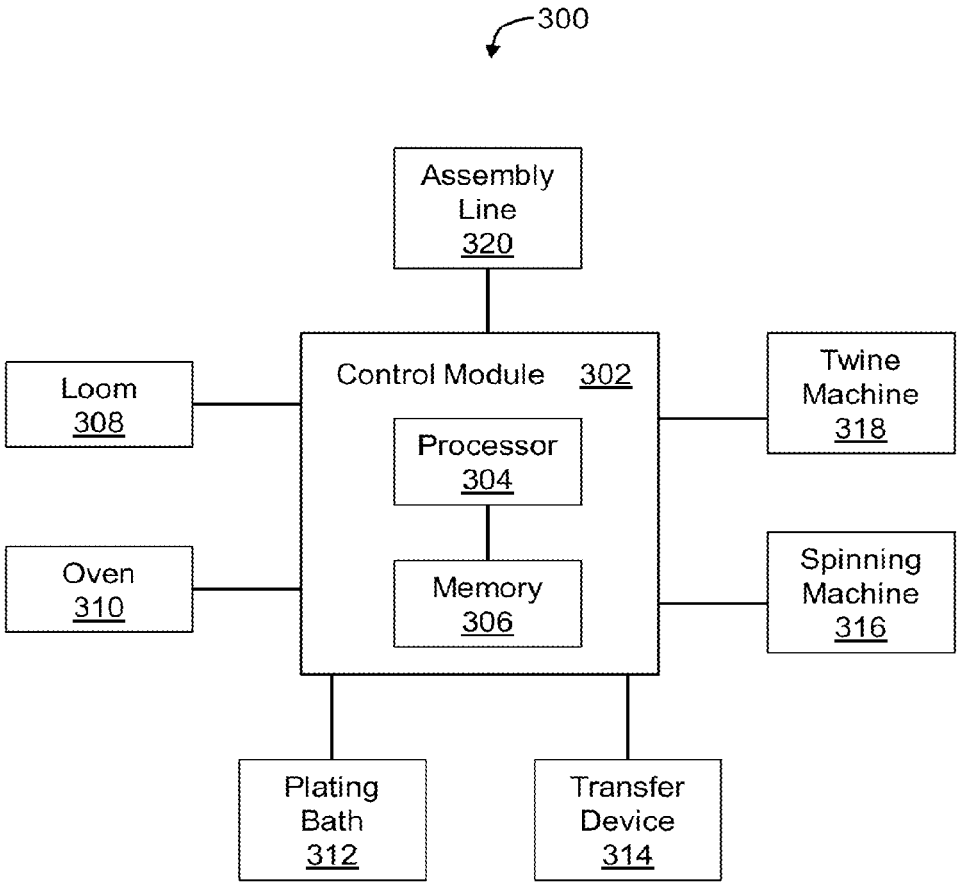
FIG. 3 is a block diagram of an illustrative embodiment of a system for forming an electrical cable.

FIG. 3 shows an illustrative example of a system 300 for forming an electrical cable, such as the electrical cable 100 of FIG. 1, arranged in accordance with at least some embodiments described herein. FIG. 3 illustrates that some or all of the components for forming an electrical cable can be controlled automatically. A control module 302 may use a processor 304 to execute computer-executable instructions stored in a memory 306. The control module 302 can be coupled to one or more of a loom 308, an oven 310, a plating bath 312 and one or more transfer devices 314. The control module 302 may be further coupled to one or more of a spinning machine 316, a twine machine 318 and an assembly line 320.

The control module 302 may be configured to control one or more of components 308, 310, 312, 314, 316, 318, 320 to perform one or more of the operations, functions or actions set forth below in an automated manner.

The loom 308 may be configured to arrange multiple resin fibers in a mesh structure including contact areas where resin fibers are in contact with each other. For instance, the loom 308 may be configured to weave resin fibers and/or resin fiber twine in a particular weave pattern, such as a plain weave pattern or other suitable weave pattern.

The oven 310 may be configured to fuse the resin fibers together at the contact areas by, e.g., heating the resin fibers at least at the contact areas above a melting temperature of the resin fibers. In other embodiments, a laser or lasers or other suitable device(s) may be used instead of the oven 310 to fuse the resin fibers together.

The plating bath 312 may be configured to plate the fused mesh structure with an electrically conductive coating, which may include one or more of copper, nickel, tin, silver, zinc, iron, gold or platinum.

The plating bath 312 may implement an electroless plating method that does not use external electrical power. For instance, the plating bath 312 may include a container within which the fused mesh structure can be immersed in an aqueous solution including metal ions (e.g., nickel ions) and a reducing agent such as sodium hypophosphite ("$NaPO_2H_2$"). The reducing agent can reduce the nickel ions such that the reduced nickel ions can be deposited on the surface of the fused mesh structure. Because electroless plating allows a constant metal ion concentration to bathe all parts of the fused mesh structure, electroless plating can deposit metal evenly on substantially all of the surface of the fused mesh structure.

In other embodiments, a vapor deposition ("VD") apparatus may be used instead of the plating bath 312 to plate the fused mesh structure with an electrically conductive coating. Such a VD apparatus may be configured to implement an electrostatic spray assisted VD ("ESAVD") method to plate the fused mesh structure with the electrically conductive coating.

The transfer device 314 can include an arm, conveyor belt, or other suitable device for transferring items from one location to another. In particular, the transfer device 314 can be configured to transfer resin fibers, mesh structures, fused mesh structures, or the like to/from one or more of the loom 308, oven 310, plating bath 312, spinning machine 316, twine machine 318, and assembly line 320.

The spinning machine 316 can be configured to spin resin such as thermoplastic polymer into one or more resin fibers.

The twine machine 318 can be configured to twist two or more resin fibers into a twine.

The assembly line 320 can be configured to assemble electrical cables from one or more constituent components such as signal lines, ground planes, insulation layers and adhesive layers. The assembly line 320 may include various devices for assembling the constituent components into electrical cables. The assembly line 320 may be fully automated, semi-automated, or manually operated.

Figure 4:
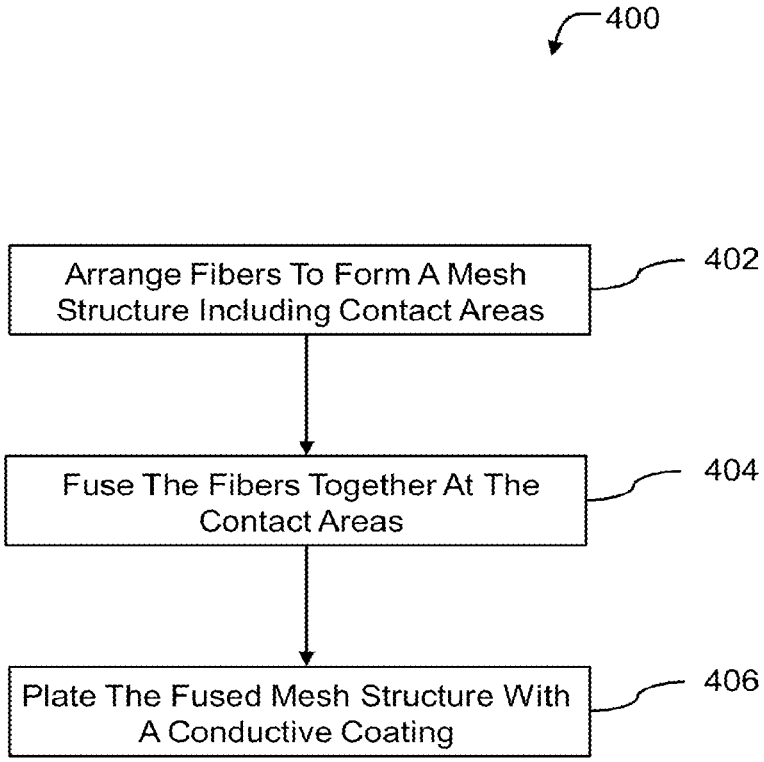
FIG. 4 shows an example flow diagram of a method of forming a ground plane, all arranged in accordance with at least some embodiments described herein.

FIG. 4 shows an illustrative example of a method 400 of forming a ground plane, arranged in accordance with at least some embodiments described herein. Method 400 includes various operations, functions or actions as illustrated by one or more of blocks 402, 404 and/or 406. Method 400 may begin at block 402.

In block 402, ["Arrange Fibers To Form A Mesh Structure Including Contact Areas"], multiple resin fibers can be arranged to form a mesh structure including contact areas where resin fibers are in contact with each other. The resin fibers can be arranged to form a mesh structure by a loom, such as the loom 308 of FIG. 3. In some embodiments, arranging the resin fibers to form a mesh structure can include weaving entwined or twined resin fibers together. The resin fibers can be woven together in a plain weave pattern or other suitable weave pattern. Block 402 may be followed by block 404.

In block 404, ["Fuse The Fibers Together At The Contact Areas"], the resin fibers can be fused together at the contact areas to form a fused mesh structure. The resin fibers can be fused together in an oven, such as the oven 310 of FIG. 3. In some embodiments, fusing the resin fibers together at the contact areas can include heating the contact areas using, e.g., an oven or a laser, or the resin fibers can be fused together using some other suitable fusing method. Block 404 may be followed by block 406.

In block 406, ["Plate The Fused Mesh Structure With A Conductive Coating"], the fused mesh structure can be plated with a conductive coating to form a ground plane. The fused mesh structure can be plated with a conductive coating in a plating bath, such as the plating bath 312 of FIG. 4, or in a VD apparatus.

One skilled in the art will appreciate that, for the processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

For instance, other functions and operations not shown in FIG. 4 or described above can be included in the method 400. As an example, the method 400 may further include spinning a resin to form the resin fibers that are subsequently arranged in block 402 to form the mesh structure. The resin can be spun to form resin fibers by a spinning machine, such as the spinning machine 316 of FIG. 3.

As another example, the method 400 may further include assembling the ground plane with multiple signal lines to form an electrical cable, such as the electrical cable 100 of FIG. 1. The ground plane can be assembled with the signal lines in an assembly line, such as the assembly line 320 of FIG. 3.

The present disclosure is not to be limited in terms of the particular embodiments described herein, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that the present disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible sub ranges and combinations of sub ranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into sub ranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. An electrical cable, comprising:

a plurality of signal lines arranged to extend along a length of the electrical cable, wherein the plurality of signal lines collectively divide the electrical cable into a top portion and a bottom portion;

a ground plane spaced apart from the plurality of signal lines, wherein the ground plane is disposed only in the bottom portion of the electrical cable and wherein the ground plane includes:

a mesh structure that includes a plurality of resin fibers fused together at a plurality of contact areas; and an electrically conductive layer that is arranged to coat the mesh structure; an insulation layer that surrounds the plurality of signal lines and the ground plane; and two adhesive layers that extend along the length of the electrical cable, wherein:

the plurality of signal lines are positioned between the two adhesive layers and one of the two adhesive layers is positioned between the plurality of signal lines and the ground plane;

each of the plurality of signal lines is electrically isolated from the ground plane along the length of the electrical cable;

a diameter of each of the plurality of resin fibers is about 0.3 millimeters;

the plurality of resin fibers comprise a thermoplastic polymer spun into fibers;

the mesh structure comprises a plurality of twines that each includes two or more resin fibers; and the plurality of resin fibers comprise one or more of polyethylene, polypropylene, polycarbonate, polyethylene terephthalate ("PET"), polyethersulfone ("PES"), polyphenylene sulfide ("PPS"), or nylon.

2. The electrical cable of claim 1, wherein the electrically conductive layer that coats the mesh structure comprises one or more of copper, tin, silver, zinc, nickel, iron, gold or platinum.

3. The electrical cable of claim 1, wherein a thickness of the electrically conductive layer is in a range from about 0.5 and about 3 micrometers.

4. A method to form an electrical cable, the method comprising:

arranging a plurality of resin fibers to form a mesh structure that includes contact areas where resin fibers are in contact with each other, wherein arranging the plurality of resin fibers to form the mesh structure comprises weaving a plurality of twines together, each twine including two or more resin fibers twined together, and wherein a diameter of each of the plurality of resin fibers is about 0.3 millimeters;

fusing the plurality of resin fibers together at the contact areas to form a fused mesh structure;

plating the fused mesh structure with a conductive coating to form a ground plane, wherein plating the fused mesh structure comprises electrostatically plating the fused mesh structure;

arranging a plurality of signal lines so as to extend along a length of the electrical cable, wherein the signal lines are spaced apart from the ground plane, wherein the plurality of signal lines collectively divide the electrical cable into a top portion and a bottom portion, and wherein the ground plane is disposed only in the bottom portion of the electrical cable;

arranging two adhesive layers so as to extend along the length of the electrical cable such that the plurality of signal lines are positioned between the two adhesive layers and one of the two adhesive layers is positioned between the plurality of signal lines and the ground plane; and forming an insulating layer so as to surround the ground plane and the plurality of signal lines.

5. The method of claim 4, further comprising spinning a resin to form the plurality of resin fibers.

6. The method of claim 4, wherein fusing the plurality of resin fibers together at the contact areas comprises heating the contact areas.

7. The method of claim 4, wherein arranging the plurality of resin fibers in the mesh structure comprises weaving the plurality of resin fibers in a plain weave pattern.

8. An electrical cable, comprising:

a plurality of signal lines arranged to extend along a length of the electrical cable;

a ground plane spaced apart from the plurality of signal lines, wherein the ground plane includes: a mesh structure comprising a plurality of resin fibers fused together at a plurality of contact areas; and an electrically conductive layer that is arranged to coat the mesh structure;

an insulation layer that surrounds the plurality of signal lines and the ground plane; and two adhesive layers that extend along the length of the electrical cable, wherein the plurality of signal lines are positioned between the two adhesive layers and one of the two adhesive layers is positioned between the plurality of signal lines and the ground plane, wherein: a diameter of each of the plurality of resin fibers is about 0.3 millimeters;

the mesh structure comprises a plurality of woven elements that each includes a single resin fiber; and wherein the plurality of resin fibers comprise one or more of polyethylene, polypropylene, polycarbonate, polyethylene terephthalate ("PET"), polyethersulfone ("PES"), polyphenylene sulfide ("PPS"), or nylon.

9. The electrical cable of claim 8, wherein the mesh structure comprises a plurality of woven elements fused together at areas of contact with each other.

10. The electrical cable of claim 8, wherein the electrical cable comprises a high-speed card cable, a flexible print circuit or a flexible flat cable.

11. An electrical cable, comprising:

a plurality of signal lines arranged to extend along a length of the electrical cable, wherein the plurality of signal lines collectively divide the electrical cable into a top portion and a bottom portion; a ground plane spaced apart from the plurality of signal lines, wherein the ground plane is disposed only in the bottom portion of the electrical cable and wherein the ground plane includes: a mesh structure that includes a plurality of resin fibers; and an electrically conductive layer that is arranged to coat the mesh structure; and an insulation layer that surrounds the plurality of signal lines and the ground plane; wherein: a diameter of each of the plurality of resin fibers is about 0.3 millimeters;

the plurality of resin fibers comprise one or more of polyethylene, polypropylene, polycarbonate, polyethylene terephthalate ("PET"), polyethersulfone ("PES"), polyphenylene sulfide ("PPS"), or nylon; the plurality of resin fibers comprise a thermoplastic polymer spun into fibers;

the mesh structure comprises a plurality of twines that each includes two or more resin fibers;

and a thickness of the electrically conductive layer is in a range from about 0.5 and about 3 micrometers.

* * * * *

UNITED STATES PATENT AND TRADEMARK OFFICE

CERTIFICATE OF CORRECTION

PATENT NO. : 8,907,220 B2
APPLICATION NO. : 13/122961
DATED : December 9, 2014
INVENTOR(S) : Fuse It is certified that error appears in the above-identified patent and that said Letters Patent is hereby corrected as shown below:

In the Specification

In Column 1, Line 6, delete "Stage Entry" and insert -- Stage Entry filing under 35 U.S.C. §371 --, therefor.

In Column 6, Line 46, delete "entwined" and insert -- untwined --, therefor.

Signed and Sealed this
Sixteenth Day of June, 2015

Michelle K. Lee

Michelle K. Lee
*Director of the United States Patent and Trademark Office*